US009242354B2

(12) United States Patent
Walsh et al.

(10) Patent No.: US 9,242,354 B2
(45) Date of Patent: Jan. 26, 2016

(54) PREHENSILE ANTI-TORQUE AND SIMULTANEOUS SUPPORT FOR POWER TOOL

(75) Inventors: Leonard M. Walsh, Plainville, CT (US); Frances L. Gudelski, Plainville, CT (US)

(73) Assignee: UNITED TECHNOLOGIES CORPORATION, Hartford, CT (US)

( * ) Notice: Subject to any disclaimer, the term of this patent is extended or adjusted under 35 U.S.C. 154(b) by 1096 days.

(21) Appl. No.: 13/275,561

(22) Filed: Oct. 18, 2011

(65) Prior Publication Data

US 2013/0091992 A1 Apr. 18, 2013

(51) Int. Cl.
*B25B 21/00* (2006.01)
*B25B 23/00* (2006.01)

(52) U.S. Cl.
CPC ..... *B25B 21/00* (2013.01); *B25B 23/0085* (2013.01); *Y10T 29/49948* (2015.01)

(58) Field of Classification Search
CPC ..... B25B 13/48; B25B 17/00; B25B 23/04; B25B 23/06; B25B 13/488; B25B 23/10; B25B 23/0085; B25B 21/00; Y10T 29/49948
USPC ..... 81/55, 57.37, 433; 75/55, 57.37, 433
See application file for complete search history.

(56) References Cited

U.S. PATENT DOCUMENTS

| | | | | |
|---|---|---|---|---|
| 521,997 | A * | 6/1894 | Whitus et al. | 408/202 |
| 1,485,062 | A * | 2/1924 | Baldus | B25B 13/488 220/DIG. 26 |
| 2,033,892 | A * | 3/1936 | Parvin | B25B 15/02 81/13 |
| 2,600,214 | A * | 6/1952 | Davis | B25B 13/06 81/13 |
| 3,526,257 | A * | 9/1970 | Kirkland | 81/431 |
| 3,750,257 | A * | 8/1973 | Berecz | 29/813 |
| 3,863,824 | A * | 2/1975 | Bakoledis | 227/10 |
| 3,907,014 | A * | 9/1975 | Manino | 81/433 |
| 4,747,294 | A * | 5/1988 | Schwartz et al. | 29/812.5 |
| 4,852,376 | A * | 8/1989 | Suhov | 29/812.5 |
| 4,972,985 | A * | 11/1990 | Smart et al. | 227/2 |
| 5,291,645 | A * | 3/1994 | Aoyama | 29/407.02 |
| 5,787,769 | A * | 8/1998 | Garuglieri | B25B 13/48 81/13 |
| 6,256,854 | B1 * | 7/2001 | Chitty et al. | 29/243.53 |
| 6,598,500 | B1 * | 7/2003 | Chivington | B25B 13/488 81/124.5 |
| 6,854,178 | B2 | 2/2005 | Fritsche et al. | |
| 7,164,474 | B2 | 1/2007 | Arntson et al. | |
| 7,200,516 | B1 * | 4/2007 | Cowley | 702/151 |
| 7,404,696 | B2 * | 7/2008 | Campbell | 408/16 |

* cited by examiner

*Primary Examiner* — Hadi Shakeri
*Assistant Examiner* — Danny Hong
(74) *Attorney, Agent, or Firm* — Carlson, Gaskey & Olds P.C.

(57) ABSTRACT

A tool for assembling parts to be connected to each other includes, a body for rotating a first end and a second end of a bolt, and a holder attaching to the body for holding a fastener against rotation and in alignment with the second end of the bolt. The fastener does not rotate while rotatably receiving the second end of the bolt.

16 Claims, 4 Drawing Sheets

PREHENSILE ANTI-TORQUE AND SIMULTANEOUS SUPPORT FOR POWER TOOL

TECHNICAL FIELD

The present invention relates to an anti-rotation device for a fastener. Specifically, the present invention relates to a device that limits the rotation of a fastener when tightening or loosening the corresponding fastener.

BACKGROUND

A gas turbine engine has several modules. The first module, in terms of axial flow path, is the compressor section. Ambient air enters the engine through the compressor section. The compressor section pressurizes the air.

The second module is the combustion section. The combustion section introduces fuel to the air previously compressed by the compressor section. The combustion section then ignites the mixture.

The third module is the turbine section. The turbine section extracts energy from the exhaust produce by the compressor section. The turbine section is coupled to the compressor section so that the exhaust drives the compressor.

Finally, the air exits the engine as thrust.

FIG. 1 is a perspective view of part of a gas turbine engine 210. The drawing shows a first module, such as a compressor section 211, adjacent a second module, such as a combustion section 213. The cases of these sections 211, 213 have corresponding flanges 215, 217 which abut and define a joint 219.

Fasteners, such as 12-point bolts 221 and nuts 223, extend through aligned openings in the flanges 215, 217 to seal the joint 219. FIG. 1 displays the conventional method of tightening the bolts 221 and nuts 223. The typical method requires the operator first to manipulate both a manual wrench W and a pneumatic impact wrench I. The manual wrench W engages the nut 223 and the pneumatic wrench I engages the bolt 221. After actuating the impact wrench I, the operator prevents rotation of the nut 223 by applying torque to the wrench W. As the bolt 221 and nut 223 tighten, the operator must apply an increasing amount of torque to the wrench W. The operator replaces the impact wrench I with another manual wrench W to provide the final torque to the fasteners. Now, the operator must apply torque to both manual wrenches W.

Loosening the bolts 221 and nuts 223 is similar. The operator engages the nut 223 with the wrench W and the bolt 221 with the second manual wrench W. The operator applies torque to both manual wrenches to loosen the fasteners slightly. Then operator then replaces the second manual wrench W with the impact wrench I. The operator then actuates the impact wrench I to remove the loosened bolt 221. The operator applies the greatest amount of torque to the wrench W during initial loosening of the fasteners. As the bolt 221 and the nut 223 loosen further, the operator can apply a decreasing amount of torque to the wrench W.

The operator must apply a typical torque of between approximately 30 and approximately 1000 in-lbs. Since the joint 19 may have up to 160 pairs of bolts 221 and nuts 223, the possibility of operator fatigue does exist. Since the engine 210 may have at least four joints 219, the possibility of fatigue becomes even more apparent.

SUMMARY

These and other features of this application will be better understood from the following specification and drawings, the following of which is a brief description:

According to an embodiment disclosed herein, a tool for assembling parts to be connected to each other includes a body for rotating one of a bolt or a fastener, the bolt having a first end and a second end. A holder attaches to the body for holding an other of bolt or the fastener against rotation and in alignment with the second end of the bolt. The other of the bolt or the fastener does not rotate while the second end of the bolt receives the fastener.

According to a further embodiment disclosed herein, a method for attaching a plurality of work pieces with a bolt, includes the steps of providing a body for rotating one of a bolt having a first end and a second end or a fastener, providing a holder attaching to the body for holding an other of the bolt or the fastener against rotation and in alignment with a second end of the bolt, gripping one of the first end of the bolt or the fastener with the holder against rotation, and driving one of the first ends of the bolt or the fastener, the second end of the bolt being received by the fastener.

According to a further embodiment disclosed herein, a method for attaching a plurality of work pieces with a bolt, includes the steps of: providing a body for manipulating a bolt having a first end and a second end, providing a holder attaching to the body for holding a fastener against manipulation and in alignment with a second end of the bolt, gripping the fastener with the holder against manipulation, and manipulating the first end of the bolt, the second end of the bolt being received by the fastener.

DETAILED DESCRIPTION OF THE PREFERRED EMBODIMENT

Figure 2:
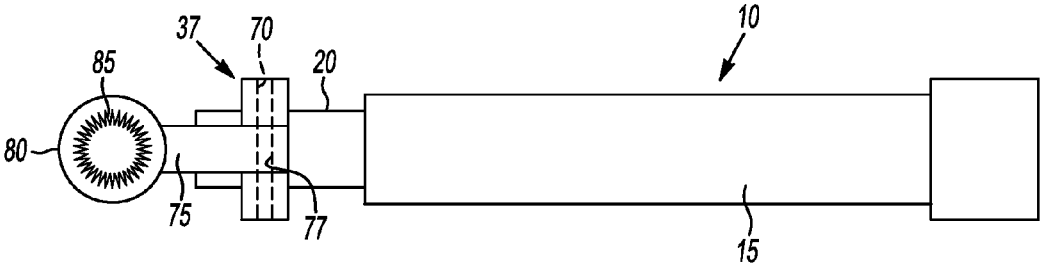
FIG. 2 is a top view of a tool showing the first embodiment described herein.
Figure 3:
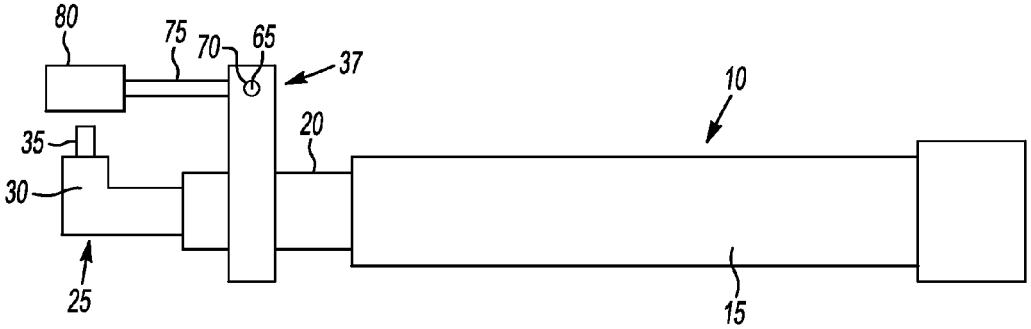
FIG. 3 is a side view of the tool of FIG. 1.
Figure 4:
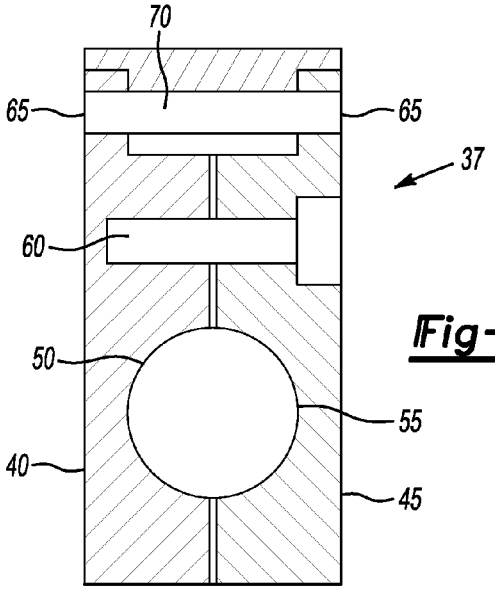
FIG. 4 is a view of a clamp used in FIGS. 2 and 3.

Referring now to FIGS. 2-4, a schematic embodiment of a tool 10, such as a driver or a wrench, is shown herein. The tool 10 includes a motor portion 15 connected to a neck 20 that connects in turn to a transverse gearing portion 25 that connects to a vertically disposed chuck 30 that holds a driver 35.

A retainer, such as a clamp 37, has a left half 40 and a right half 45. A semi-circular recess 50 is disposed in the left half 40, and a semi-circular recess 55 is disposed in the right half 45. The semi-circular portion 50 is in register with the semi-circular portion 55 to encircle the neck 20 which may have a tapered shape. A tensioning bolt 60 keeps the right half 45 and the left half 40 together to engage the neck 20 securely. Each half 40, 45 has a pivot hole 65 that holds a pivot pin 70.

A flange 75, which acts as a connector, has a hole 77 therein for receiving the pivot pin 70 to allow the flange 75 to rotate relative to the clamp 37. The flange 75 also attaches/connects to a fastener holder 85. One of ordinary skill in the art will also recognize that other ways to hold the flange 75 for rotation relative to the clamp 37 (and at different positions therein) are within the teachings herein.

Figure 5:
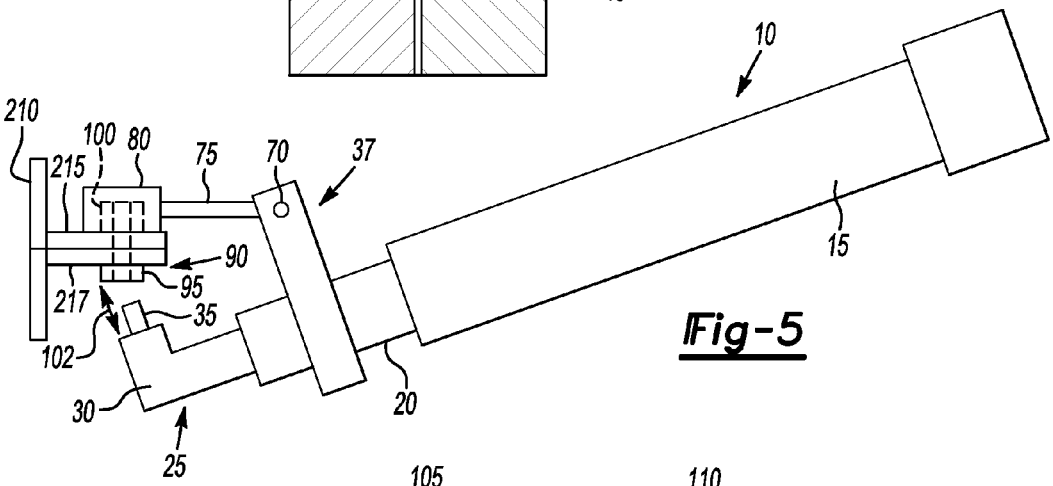
FIG. 5 shows a view of the tool of FIG. 1 being used.

Referring to FIG. 5, flanges 215 and 217 of the engine 210 are to be connected by a threaded bolt 90, which has a bolt head 95, and a fastener 100, such as a nut that screws onto the bolt 90. The tool 10 is tilted downwardly and the fastener holder 80 is placed over the fastener 100 to prevent the fastener 10 from rotating. The tool 10 is then rotated clockwise about the pivot pin 70 to have the drive 35 engage bolt, in this case through its head 95. Once the bolt head 95 is engaged with the driver 35, the tool 10 may be activated to rotate/manipulate the entire bolt 90 into the fastener 100 so that the bolt and nut are securely fastened without rotation of the fastener 100. The tool 10 may be a torque wrench and the bolt will then be securely fastened to the fastener without significant variation to the torque required. One of ordinary skill in the art will recognize from the teachings herein that other types of bolts or pins, including bolts without heads, may be utilized to connect the flanges 215, 217.

Figure 1:
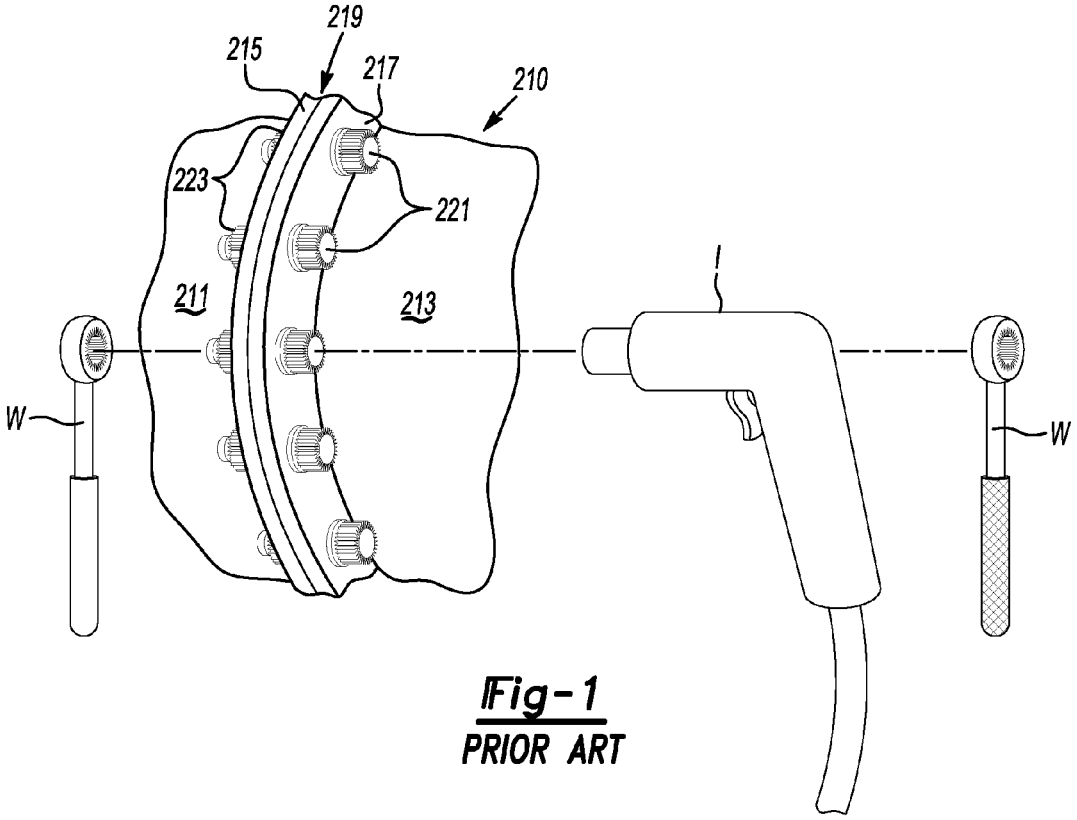
Fig-1 PRIOR ART
FIG. 1 is prior art view of a methodology for attaching bolts to an aircraft component.
Figure 6:
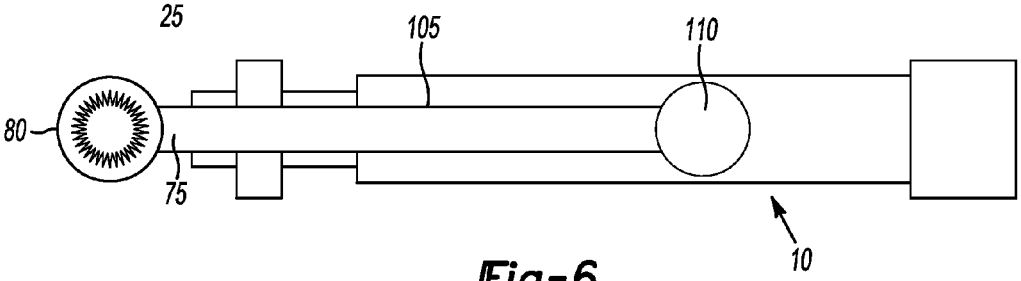
FIG. 6 shows a variant of the tool of FIG. 1.
Figure 7:
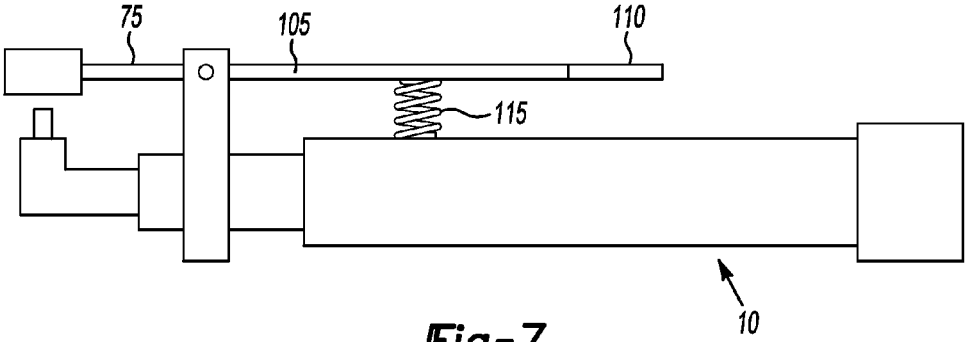
FIG. 7 shows a side view of the tool of FIG. 6.

Referring now to FIGS. 6 and 7, one can see now that the flange 80 has an extension 105 that ends in a thumb portion 110. A spring 115 is disposed between the motor portion 15 and the extension 105 to urge the fastener holder 80 into contact with the fastener 100 if the extension 105 and thumb portion 110 are not manipulated by the user. The spring 115, which may also be a linear spring (not shown), is securely attached to the lever 105 and the tool 20 to minimize foreign object damage to any parts. Additionally, the spring may be a torsional spring (not shown) attached to the pin 70. The flange 80 can now be manipulated by the thumb of a user holding the tool 10 and manipulating the thumb portion 110 so that one's other hand may be used to align the bolt 90 and the fastener 100. One hand operation can greatly speed the installation of nuts and bolts and minimize user fatigue. There is no longer any need to use a wrench W, as shown in FIG. 1.

Figure 8:
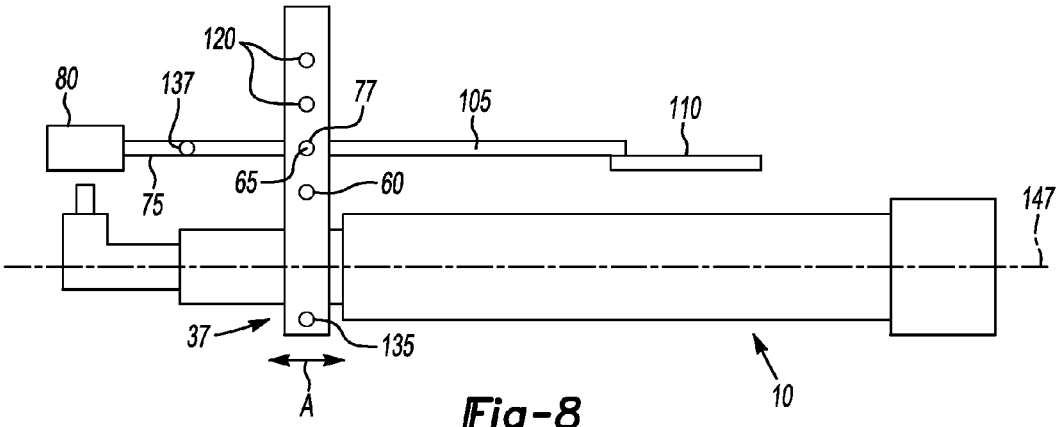
FIG. 8 shows a still further variant of the tool of FIG. 1.
Figure 9:
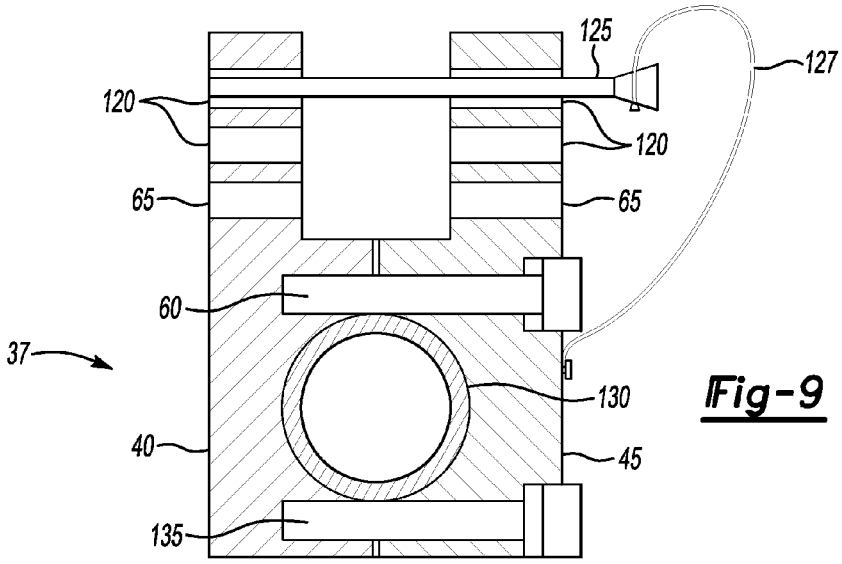
FIG. 9 shows a variant of a clamp for use with the tool of FIG. 8.

Referring now to FIGS. 8 and 9 it is seen that the driver shown herein is adjustable for differing situations a user may encounter. The flange 80 and its extension 105 may adjusted to pivot around openings 120 that are placed in each clamp half 40, 45 radially outboard from an axis 147 along which the tool 10 is disposed. This gives the tool the ability to secure flanges 215 and 217 to each other as shown in FIG. 5 that may be thicker and require longer bolts than as shown in FIG. 1. A quick release pin 125, which may screw into openings 120 or 65, may extend through the flange 75 and allow rotation thereabout at differing location radial locations along the clamp 37. The quick release pin 125 may be attached to the clamp by a lanyard 127 by conventional means to minimize foreign object damage to a part 210 or loss of the quick release pin 125. One of ordinary skill will recognize that the openings 120 may be designed for the thickness of the flanges 215, 217 and the lengths of the bolts 90.

Flange 80 may also have additional openings 137 to allow for more than one pivot point of the flange 80 and the extension 105 to adjust for lower degrees or articulation as may be required. To use such an opening 137, the quick release pin 125 is removed from the opening 77, as is shown, or any of the holes 120, from opening 77 and reinserted in opening 137 and in any of openings 77 or openings 120 as may be required. Furthermore, as indicated by arrow A, the clamp screws 135 and 60 may be loosened to move forward or backwardly, as each application may require, to enable fastener holder 80 to engage fastener 100. One of ordinary skill in the art will readily understand given the teachings herein, that the clamp 37 may have different openings in different places and the flange 75 and extension 105 may have holes in variable positions depending on necessities of the flanges 215, 217 and holders 80 and bolts 90 to be used. One of ordinary skill in the art will also recognize that other ways to hold the flange 75 for rotation relative to the clamp 37 along a length of the flange 75 are within the teachings herein.

One can see in FIG. 2 that a 12 point socket wrench acts as the fastener holder 80. However, referring now to FIG. 11, other shapes of fastener holders 80 may be used. For instance an Allen head 150, a box end 155, an open end 160, a flare nut end 165, a non-ratchet head 170, or a reversible ratchet 175, or any other fastener holder may be used. One of ordinary skill in the art will readily recognize that other shapes may be chosen for the use at hand.

Figure 10:
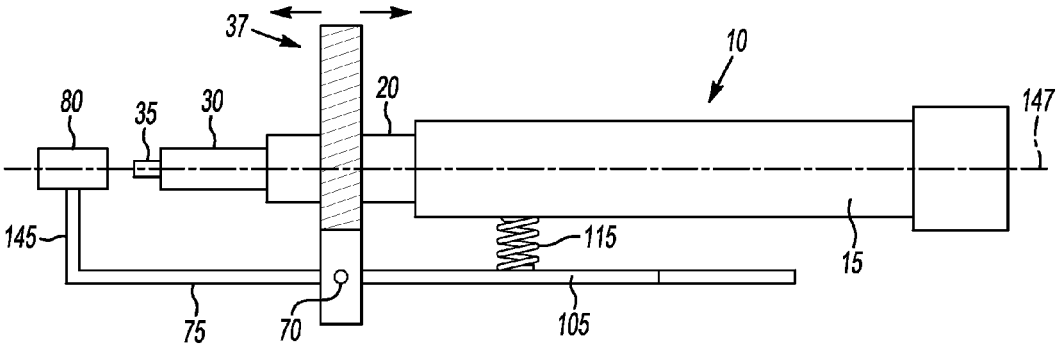
FIG. 10 shows a second embodiment of a tool employing the concepts disclosed herein sectional.
Figure 11A:
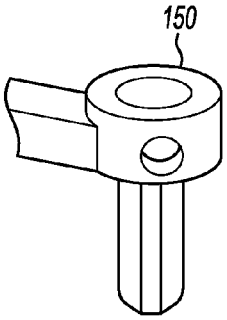
FIG. 11A shows a first non-limiting embodiment of a fastener holder that may be exemplarily used herein.
Figure 11B:
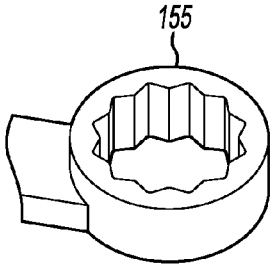
FIG. 11B shows a second non-limiting embodiment of a fastener holder that may be exemplarily used herein.
Figure 11C:
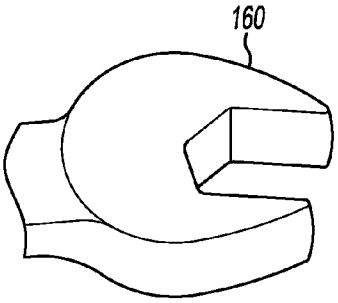
FIG. 11C shows a third non-limiting embodiment of a fastener holder that may be exemplarily used herein.
Figure 11D:
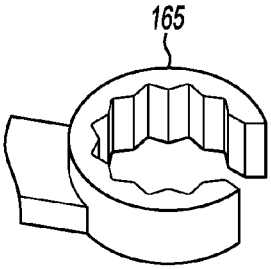
FIG. 11D shows a fourth non-limiting embodiment of a fastener holder that may be exemplarily used herein.
Figure 11E:
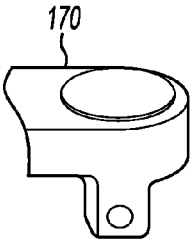
FIG. 11E shows a fifth non-limiting embodiment of a fastener holder that may be exemplarily used herein.
Figure 11F:
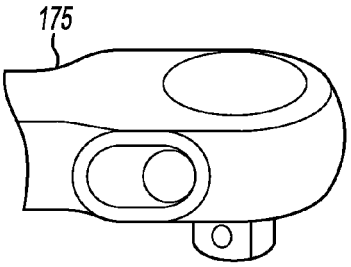
FIG. 11F shows a sixth non-limiting embodiment of a fastener holder that may be exemplarily used herein.

Referring now to FIG. 10, a second embodiment is shown here. In this embodiment the transverse gearing portion 25 is removed so that the driver 35 acts to rotate in plane with the driver 110 along axis 147. The embodiment in this instance is similar in all aspects to the tool 10 of the previous embodiment except that the flange 80 now has a portion 145 extending at a right angle to the axis 147 and to the flange 75. The portion 145 now attaches to the fastener holder 80 that aligns with the driver 35, the bolt 90 and the fastener 100 for assembly along that axis. One of ordinary skill in the art will readily recognize that other orientations between the driver 35 and the tool 10 are possible by providing the proper bend to the flange 75. In this embodiment, the clamp 37 may slide along the neck 20 to account for the proper thicknesses of any vertically disposed flanges (not shown).

Figure 12:
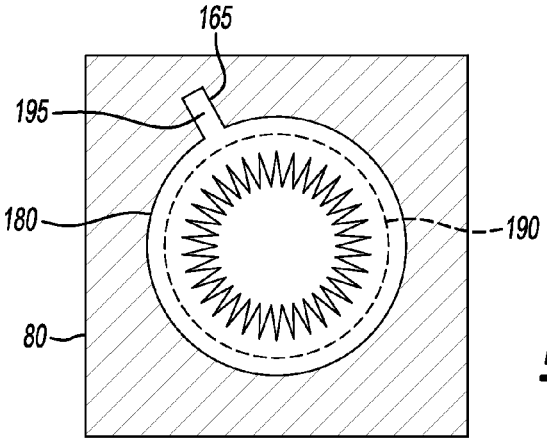
FIG. 12 shows a second embodiment of the fastener holder that may e used with the embodiments disclosed herein.

Referring now to FIG. 12, the holder 80 is shown having a shaped, non-circular opening 180 including a keyhole 185, an insert 190 having a twelve-point grip 192 for holding a fastener 100 (see FIG. 5) and a key 195 for mating with keyhole 185 such that the insert 190 does not rotate relative to the holder 80. A shelf or other mechanism 197 prevents the insert 190 from passing through the insert 80. One of ordinary skill in the art will also recognize that other ways to hold the insert 190 within the holder 80 are within the teachings herein.

One of ordinary skill in the art will also recognize that the tool 10 shown herein may also rotate the nut 223 while preventing the bolt 221 from rotation.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A tool for assembling parts to be connected to each other, said tool comprising:

a body for rotating one of a bolt and a fastener, said bolt having a first end and a second end; and a holder connected to an attachment wherein said attachment is pivotably attached to said body by a retainer, said attachment pivotable about a longitudinal axis of said body, wherein said attachment has a plurality of positioning openings along a length thereof for attaching said holder to said body at different positions corresponding to said plurality of positioning openings, said holder for holding the other of said bolt and said fastener against rotation and in alignment with said second end of said bolt, wherein said other of said bolt and said fastener does not rotate while said second end of said bolt is received by said fastener.

2. The tool of claim 1 further comprising a driver attached to said body for engaging said first end of said bolt or said fastener, said driver and said one of said bolt and said fastener disposed along an axis.

3. The tool of claim 1 wherein said holder is slidable along said body for adapting to a thickness of a workpiece.

4. The tool of claim 1 wherein said attachment is angled.

5. The tool of claim 1 further comprising said attachment having an extension for manipulation by a user to rotate said attachment.

6. The tool of claim 1 wherein said holder includes an opening having a non-circular shape for receiving an insert having an outer shape mating with said non-circular shape and an inner shape for engaging said fastener.

7. The tool of claim 6 wherein said non-circular shape includes a key-hole and said non-circular shape includes a key.

8. The tool of claim 6 wherein said body prevents unintended movement of said insert.

9. The tool of claim 1 further comprising a driver attached to said body for engaging said first end of said bolt, wherein said driver and said bolt are not disposed along a common axis.

10. The tool of claim 9 wherein said driver and said body are disposed at about a 90 degree angle relative to each other.

11. The tool of claim 1 further comprising a lever attaching to said attachment for rotating said attachment away from said one of said first end of said bolt or said second end of said bolt or said fastener.

12. The tool of claim 11 further comprising a spring for urging said lever towards said one of said first end of said bolt or said second end of said bolt, or said fastener.

13. A method for attaching a plurality of work pieces with a bolt and fastener, said method comprising:

providing a body for rotating one of a bolt and a fastener, said bolt having a first end and a second end;

providing a holder connected to an attachment wherein said attachment is pivotably attached to said body by a retainer, said attachment pivotable about a longitudinal axis of said body, wherein said attachment has a plurality of positioning openings along a length thereof for attaching said holder to said body at different positions corresponding to said plurality of positioning openings, said holder for holding the other of said bolt and said fastener against rotation and in alignment with a second end of said bolt;

gripping said other of said bolt and said fastener with said holder against rotation; and driving said one of said bolt and said fastener, such that said second end of said bolt is received by said fastener.

14. A method for attaching a plurality of work pieces with a bolt and fastener, said method comprising:

providing a body for manipulating a bolt having a first end and a second end;

providing a holder connected to an attachment wherein said attachment is pivotably attached to said body by a retainer, said attachment pivotable about a longitudinal axis of said body, wherein said attachment has a plurality of positioning openings along a length thereof for attaching said holder to said body at different positions corresponding to said plurality of positioning openings, said holder for holding a fastener against manipulation and in alignment with a second end of said bolt;

gripping said fastener with said holder against manipulation; and manipulating said first end of said bolt, said second end of said bolt being received by said fastener.

15. The method of claim 14 further comprising rotating said attachment relative to said body about an axis spaced apart from said body, said axis extending substantially perpendicular to an axis about which said body is disposed.

16. The method of claim 14 further comprising rotating said attachment relative to said body about an axis spaced apart from said body, said axis extending substantially perpendicular to an axis about which said body is disposed.

* * * * *